United States Patent [19]

Malvasio

[11] 4,422,202

[45] Dec. 27, 1983

[54] INVERTIBLE FLOOR BROOM

[76] Inventor: William A. Malvasio, 608 S. Browns Lake Dr., Burlington, Wis. 53105

[21] Appl. No.: 359,199

[22] Filed: Mar. 18, 1982

[51] Int. Cl.[3] ..... A46B 9/00

[52] U.S. Cl. ..... 15/106; 15/172; 15/176; 15/DIG. 6

[58] Field of Search ..... 15/106, 107, 160, 172, 15/176, DIG. 5, DIG. 6

[56] References Cited

U.S. PATENT DOCUMENTS

| | | | |
|---|---|---|---|
| 282,137 | 7/1883 | White | 15/176 X |
| 845,928 | 3/1907 | Brooks | 15/107 |
| 894,385 | 7/1908 | Johnson | 15/172 X |
| 1,141,478 | 6/1915 | Mount | 15/106 |
| 2,043,758 | 6/1936 | Lay | 15/159 |
| 2,124,647 | 4/1937 | Bauler | 15/176 |
| 3,633,974 | 1/1972 | Lewis, Jr. | 300/21 |
| 3,755,847 | 8/1973 | Liebecher | 15/176 |
| 3,945,080 | 3/1976 | Hammer | 15/172 X |
| 4,037,369 | 7/1977 | Campbell | 15/159 A |

FOREIGN PATENT DOCUMENTS

| | | | |
|---|---|---|---|
| 884771 | 11/1971 | Canada | 15/160 |
| 588092 | 4/1925 | France | 15/160 |
| 795738 | 1/1936 | France | 15/106 |

*Primary Examiner*—Peter Feldman

*Attorney, Agent, or Firm*—Arthur J. Hansmann

[57] ABSTRACT

An invertible floor broom presenting a cylindrical head of bristles of two different groups having different flexibilities and having a visual markings for distinguishing the two groups. Four quadrants of bristles can be presented to the floor being swept, and the handle is reversible on the broom which is invertible for the purpose mentioned.

5 Claims, 3 Drawing Figures

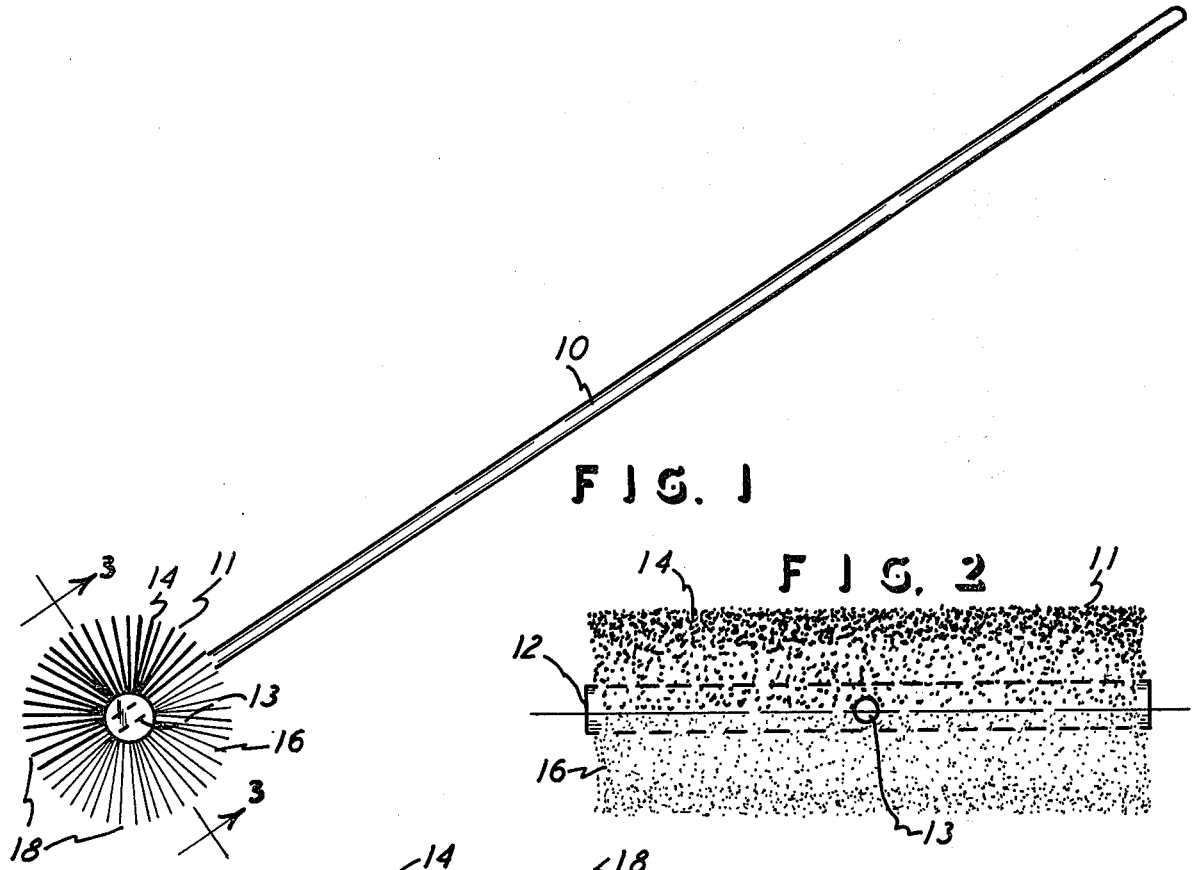
FIG. 1
FIG. 2
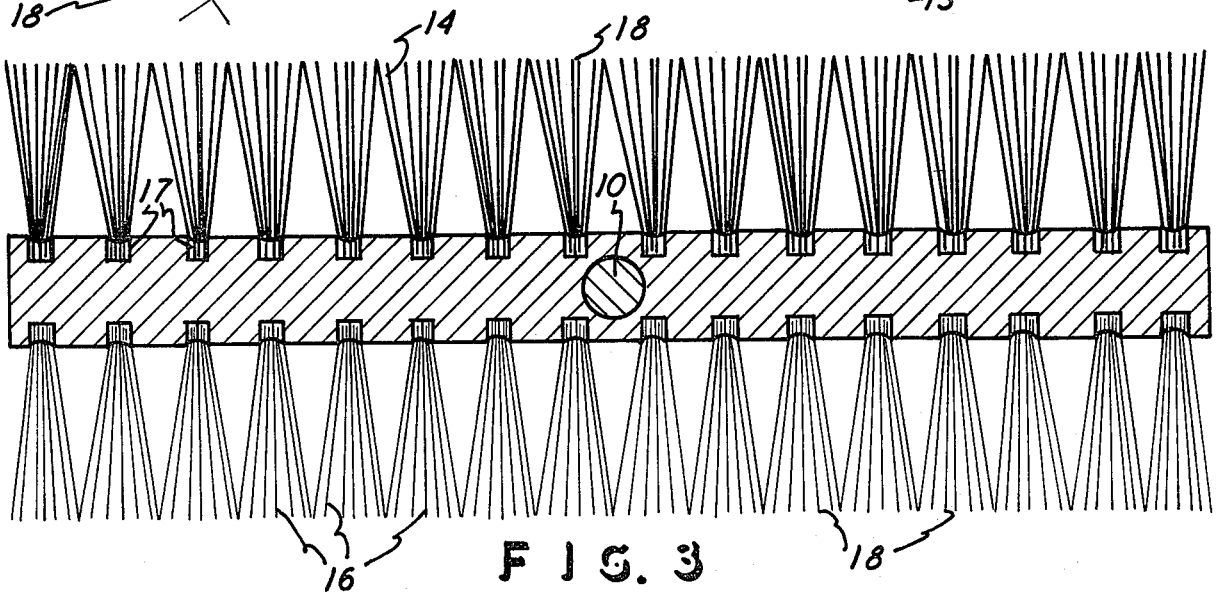
FIG. 3

INVERTIBLE FLOOR BROOM

This invention relates to an invertible floor broom, and, more particularily, it relates to a push broom.

BACKGROUND OF THE INVENTION

The prior art is already aware of push brooms which are in common use today, and it is also aware of brooms and the like which have bristles of two different stiffnesses, and one such prior art example is seen in U.S. Pat. No. 2,043,758. Another example of prior art patent which shows a brush or the like having fibers or bristles of different stiffnesses or abrasive characteristics is U.S. Pat. No. 4,037,369.

The present invention relates to the floor broom, and the broom has a sweeping head in a cylindrical formation and having bristles of two different stiffnesses on diametrically opposite sides of the head. With that arrangement, the floor broom of this invention can be inverted and thus the bristles of the particular stiffness can be presented to the floor, depending upon the upright or inverted position of the broom head. In that context, the prior art is also already aware of brushes or brooms which have their tufts or bristles or the like in a cylindrical pattern, and examples of such are shown in U.S. Pat. Nos. 2,124,647 and 3,633,974 and 3,755,847 and 3,945,080. This group of prior art patents shows brushes different from the present invention in that the present invention is related to an invertible floor broom which has bristles of two different stiffnesses on diametrically opposite sides of the broom, all for permitting selective use of either group of bristles, depending upon the nature of the material being swept and the surface which is being swept.

With regard to the first two patents mentioned above, the bristles or fibers disclosed therein are of different stiffnesses but they are all simultaneously presented to the surface being swept, and there is no arrangement or possibility for selectively presenting bristles of only one stiffness, according to the material and surface being swept.

Another distinction, and an advantage and object of the present invention, compared to the aforesaid patents is that the broom of the present invention is arranged in a cylindrical pattern and with bristles of different stiffnesses on diametrically opposite sides of the cylinder so that the user can present bristles of either stiffness to the surfaces to be swept, and also the angle of sweeping is the uniform regardless of the angle at which the broom handle is held.

Still further, the present invention provides an invertible floor broom wherein the user can visually, and thus readily, determine the location of the bristles of two different stiffnesses, and thus the user can utilize the desired bristles and their particular stiffness, all according to the requirements for optimum sweeping of the material and the surface being worked upon at that time. In accomplishing this object, and in distinguishing over the prior art, the broom of the present invention has an elongate member on which the bristles of two different stiffnesses are mounted and present the cylindrical broom head, and the elongate member has two diametrically opposite holes for receiving the broom handle, all for permitting utilization of any one of the four quadrants of the sweeping cylinder.

BRIEF DESCRIPTION OF THE DRAWINGS

FIG. 1 is a side elevational view of a preferred embodiment of this invention.

FIG. 2 is an elevational view of the broom head shown in FIG. 1, and with the view being taken from the handle end.

FIG. 3 is an enlarged sectional view taken along the line 3—3 of FIG. 1.

DETAILED DESCRIPTION OF THE PREFERRED EMBODIMENT

The invertible floor broom of this invention is the push broom type, and it has the customary handle 10 and it also has the broom head generally designated 11. The handle 10 is of the usual length for a push broom, and it may be a wood or the like pole, and it extends for a distance sufficient for the comfort of the user.

The head 11 is cylindrically shaped, as shown between FIGS. 1 and 2, and it includes a central and elongate member 12 which extends perpendicular to the length of the handle 10. The member 12 has a threaded opening 13 extending therethrough, and thus the handle 10 can threadedly attach to the member 12 from either diametrically opposite side of the member 12, and of course the threads on the inside of the hole 13 are right hand threads on opposite ends of the hole 13 so that the handle can be conventionally turned into the hole 13 to be secured with the member 12 and extend to either selected side of the member 12. Thus, the hole 13 can be considered as two holes on diametrically opposite sides of the center of the member 12, all so that the handle 10 can be attached to form a T-shape with the member 12 and extend from either of the two opposite sides of member 12. Also, the member 12 can be a wood or like material block and it too may be of a cylindrical shape, as shown in FIGS. 1 and 2. It will therefore be understood that the lower end of the handle 10 is threaded for threaded engagement with either end of the hole 13, and that is a known or conventional arrangement for threading handles into brooms or mops or the like, such as shown in U.S. Pat. No. 3,945,080.

In addition to the elongate member or central block 12, the head 11 includes two groups of bristles 14 and 16. The drawings show each group of the bristles 14 and 16 to be in a semi-circular pattern on the block 12 and sufficiently connected or attached thereto, such as by being embedded in the openings 17 in the block 12. Each group of bristles extend from the block 12 to the bristle extending ends 18 to thereby form a circular pattern of bristle ends 18 and to thus create the cylindrical shape for the head 11. The particular manner of connecting the bristle 14 and 16 to the member 12 is not critical, and any conventional mode of connection may be employed. FIG. 3 shows the bristles 14 and 16 to be in rows extending along the length of the member 12, but any pattern for connecting the bristles to the member 12 may be employed. The important feature is that the extending bristle ends 18 from a pattern, such as the cylindrical pattern shown and mentioned, so that the user can place the handle 10 at any particular angle with respect to the horizontal surface being swept, and the bristles presented to the floor at that handle angulation will be at an appropriate angle for the sweeping process.

An important feature is that the bristles 14 are shown to be of a certain gauge or cross-sectional size and are thus of a certain flexibility or what is termed stiffness. Conversely, the bristles 16 are shown to be of a thinner or smaller gauge in thickness, and they are therefore indicated to be of a stiffness or flexibility less than that of the bristles 14. With that arrangement, the two groups of bristles 14 and 16 extend in their semi-circular and respective patterns on the head 11 and are of two different flexibilities so that each can be utilized for a particular sweeping operation. For instance, the stiffer and larger bristles 14 can be used for sweeping heavy material, compared to the size and weight and resistance presented by any lighter material where-upon the more flexible and thinner bristles 16 would be utilized. That is, FIG. 1 shows the broom in the position where the thinner bristles 16 are presented to the surface being swept, and if the handle 10 were swung counter clockwise to extend to the left of the present position of the head 11, then the heavier bristles 14 would be presented to the floor and they would then be utilized for the sweeping.

Still further, the handle 10 can be connected with the head 11 by approaching either diametrically opposite side of the head 11. As shown in FIG. 1, the quadrant of bristles 16 at what is then the six o'clock position of the bristle 16 is available for sweeping. If the handle 10 were connected through the hole 13 at the diametrically opposite side from that shown in FIG. 1, then the bristles 16 at the three o'clock position would be available for presenting to the floor for sweeping. Further, if the entire broom were flipped over from the position shown in FIG. 1, then the heavier bristles 14 at the nine o'clock position would be available for sweeping; and again, if the handle 10 were connected from the other side of the hole 13, then the heavier bristles at the twelve o'clock position would be available for sweeping. In that arrangement, all four quadrants of the cylindrical head 11 can be utilized at any one time, and thus maximum use made of the broom head 11, in addition to having the selectivity of using either the heavy or fine bristles 14 and 16, as well as having the advantage of placing the respective bristles at the optimum angle with respect to sweeping or being able to hold the handle 10 at the most comfortable position depending upon the users height or desires heightwise.

Finally, in order for the user to determine which of the bristles in groups 14 or 16 are the so-called heavy or lighter bristles, and that is with regard to their size and consequent flexibility when all bristles are made of the same material such as any common materials used for forming a broom, the respective bristle groups 14 and 16 are arranged for visual distinction between the two groups 14 and 16. For instance, the heavier group 14 can be of a complete black color, and the lighter or finer group 16 can be of a white color. That is, there can be any color or visual type of distinguishing feature between the two groups of bristles 14 and 16, but in all instances the finer bristles 16 are of a brightness greater than that of the bristles 14 which therefore connote a heavier physical characteristic by virtue of the darker color for the bristles 14. In this context, the word "brightness" has its scientific definition being the luminous intensity, of an object in the direction of viewing the object, per unit of area projected along the direction of viewing. Therefore, the color of the finer and more flexible bristles 16 is of a lighter color and therefore of a greater brightness than that of the bristles 14 and the other group of bristles.

Therefore the head 11 consists of the two groups of bristles 14 and 16 which have visual markings to distinguish the two different sizes and/or flexibilities of the two groups of bristles, and the head 16 is a cylindrical shape and has means for presenting four quadrants of sweeping bristles to the sweeping surface. Thus, the so-called two threaded openings 13 on diametrically opposite sides of the elongate member 12 are at the juncture between the two groups of bristles 14 and 16, as shown in the three views in the drawings. With the color code or visual markings described, the user will readily know which bristles are presented downwardly to the sweeping surface.

What is claimed is:

1. A floor broom, comprising an elongate member, and an elongate handle releasably connected to said member on either diametrically opposite face of said member to extend perpendicular to the length of said member and with the length of said handle extending along a plane extending on the length of and through said member and defining two opposite sides of said member, a first group of flexible bristles attached to said member and extending along the length thereof throughout one of said two opposite sides of said member and being of a uniform stiffness, a second group of flexible bristles attached to said member and extending along the length thereof throughout the other of said two opposite sides of said member and being of a stiffness less than said uniform stiffness, all of said bristles terminate in their extent from said member in the formation of a full cylinder of 360 degrees of angulation of said bristles, all for alternating selective sweeping use of either group of said bristles, and all for selection of any one of the four quadrants of the 360 degrees being presentable closest to the floor to be swept and when said handle is at 45 degrees to the horizontal.

2. The floor broom as claimed in claim 1, including visual marking on said bristles for distinguishing the two said groups of bristles from each other.

3. The floor broom as claimed in claim 2, wherein said visual marking consists of different colors on each of said groups of bristles.

4. The floor broom as claimed in claim 3, wherein the color of said first group is of a luminous brightness less than the brightness of the color of said second group.

5. The floor broom as claimed in claim 4, including said member having a threaded opening extending on each diametrically opposite side thereof for selectively receiving said handle, said threaded openings being located along said plane and between said two groups of bristles.

* * * * *